United States Patent [19]

Eisermann et al.

[11] Patent Number: 4,817,404

[45] Date of Patent: Apr. 4, 1989

[54] REVERSIBLE BOLT LOCK, SPECIFICALLY WITH A LOCKING FUNCTION RELEASED BY COIN DROP

[75] Inventors: Armin Eisermann, Velbert 1; Diethard Geiger, Wülfrath, both of Fed. Rep. of Germany

[73] Assignee: Schulte-Schlagbaum Aktiengesellschaft, Fed. Rep. of Germany

[21] Appl. No.: 831,975

[22] Filed: Feb. 20, 1986

[30] Foreign Application Priority Data

Mar. 11, 1985 [DE] Fed. Rep. of Germany ..... 3508613

[51] Int. Cl.[4] ..... E05B 63/06

[52] U.S. Cl. ..... 70/134; 70/379 R; 70/462; 70/DIG. 41; 70/DIG. 66; 292/244

[58] Field of Search ..... 70/DIG. 41, DIG. 66, 70/462, 379 A, 379 R, 380, 134; 292/244, 245; 411/911, 367, 368

[56] References Cited

U.S. PATENT DOCUMENTS

| | | | |
|---|---|---|---|
| 420,285 | 1/1890 | Meyer | 70/DIG. 66 X |
| 960,237 | 5/1910 | Thomson | 411/368 X |
| 977,102 | 11/1910 | Kuba | 70/DIG. 41 X |
| 1,120,294 | 12/1914 | Farnsworth | 70/DIG. 41 X |
| 1,149,990 | 8/1915 | Baird | 70/DIG. 41 X |
| 1,158,446 | 11/1915 | Coffin | 70/462 |
| 1,251,676 | 1/1918 | McCaffray | 411/368 |
| 1,444,325 | 2/1923 | Bucknam | 70/DIG. 41 X |
| 1,820,565 | 8/1931 | Hines | 70/462 X |
| 2,666,252 | 1/1954 | Temple | 411/368 X |
| 2,695,805 | 11/1954 | Raper | 70/462 X |
| 2,984,698 | 5/1961 | Strauss | 411/510 X |
| 3,161,450 | 12/1964 | Goodenough | 411/911 X |
| 3,253,625 | 5/1966 | Oestereicher | 411/911 X |
| 4,572,348 | 2/1986 | Eisermann et al. | 70/DIG. 41 X |

*Primary Examiner*—Robert L. Wolfe
*Assistant Examiner*—Suzanne L. Dino
*Attorney, Agent, or Firm*—Wood, Herron & Evans

[57] ABSTRACT

A lock of the type having a locking function released by a coin drop is disclosed. The lock includes a lock box housing which carries a locking cylinder and a shiftable operating element. A separate support casing is mounted on a door and carries a reversible latch element having two heads and an open box-like frame. The frame is provided with two openings for receiving the operating element. A separate spring-loaded slide is provided for urging the latching element in a forward locking direction.

7 Claims, 5 Drawing Sheets

REVERSIBLE BOLT LOCK, SPECIFICALLY WITH A LOCKING FUNCTION RELEASED BY COIN DROP

BACKGROUND OF THE INVENTION

The invention concerns a lock, specifically with a locking function released by coin drop, with a latch member which is movable by key operation, with the key operating force attacking at an edge of the latching member tail which extends equidirectionally with the path of movement of the head.

Locks of this type are previously known. The latching element is generally fashioned as a thrust latch which on its edge extending equidirectionally with the path of movement has locking engagement openings for the key operation. Upon assembly, the lock is fixed for one application.

The problem underlying the object of the invention is to so design a lock of this category, in a manner easy to manufacture, that an extended area of application will be given.

SUMMARY OF THE INVENTION

The present invention is predicated upon the concept of providing an improved lock with a locking function released by a coin drop, which lock includes a reversible latching element having two heads formed on opposite ends. The latching element includes two openings formed on its upper and lower longitudinal edges adapted to receive an actuating element shiftable in response to the rotation of a key in a lock cylinder. The locking mechanism and actuating member are carried by a lock box housing, while the latch member, together with a separate spring-loaded slide, are mounted in a separate support casing to which the lock box can be secured. As a result of this construction, ready access is obtained to the latching member without requiring disassembly of the components of the locking mechanism.

The subclaims represent favorable advancements.

One advantage of the present lock construction is that the range of applications of the lock is extended. Upon assembly and shipment, for one, the lock may be coordinated with the door in the version shipped. In this case, the one head of the latching element will be used. But for another it is possible as well to turn the latching element 180° and use the other head. It goes without saying that the heads have different designs so that a changeover is possible in a simple way. Variations can be made on the heads regarding their cross section and length. After the latching element is turned, the key operating force attacks then on the other edge of the latching element tail which is provided with the engagement opening. Material savings and an ensuring weight reduction result from the fact that the latching element tail has a frameshaped design. The two opposite heads originate from the end sides of the frame, while the frame shanks extending in the direction of movement are provided with the engagement openings. The lock becomes even more versatile when providing the one head with a bevel and springloading the latching element in forward closing direction. The corresponding void of the one engagement opening, relative to the key operating element, permits a latch bolt operation of the lock. When moving the key operating element to a locking position, the head forming the latch bolt engages a locking component on the frame. It is possible, for instance, to produce the locked position of the key operating element when the door is opened. If the door is slammed shut, the latching element yields first against the spring load. If the beveled head is in alignment with the corresponding locking recess, the latching element can snap forward, spring-loaded, in locking position. The opening of the lock takes place by means of the key operating element, which is being retracted and entrains the latching element. in the retracted position of the key operating element, the beveled head is retracted as well. On locks where the locking function is released by coin drop it is especially favorable to arrange the latching element in the back plate of the lock box. The proven design of such coin locks need not be modified essentially. All that is necessary is providing a clutch between the coin lock and the latching elmement. The cylinder provided on these coin locks can extend through the frame opening which is provided anyway in the latching element tail. The latching element not being directly stressed by the spring acting upon it, the latching element can be easily turned. The respective compression spring lies protected in the slide which can be inserted in the back plate. Such key locks being normally mounted on the inside of the door, a removal of the lock box from the door outside must not be possible. However, the installation from the door outside is desired. It is performed in such a way that first the back plate is fastened on the door inside by means of screws extending through the door. Their heads bearing on the front of the door are so designed that only inward forces can be transmitted, thereby fastening the back plate with the aid of the screws engaging the entrance openings in the back plate. Next, the lock box can be screw-mounted on the door inside using screws which are accessible from the lock box and engage the back plate. Removing the lock requires first the removal of the lock box. Only then are the screw ends, provided with gripping faces and facing toward the lock box, accessible to the removal tool. For instance, the ends may be provided with a hex socket which the removal tool then engages in form-fitting fashion. The entrance openings are preferably arranged in insert bushings of the back plate. The insert bushings have out-of-round head plates which prevent them from rotating to facilitate the installation.

An embodiment of the invention will be explained hereafter with the aid of FIGS. 1 through 10.

DESCRIPTION OF A PREFERRED EMBODIMENT

Figure 1:
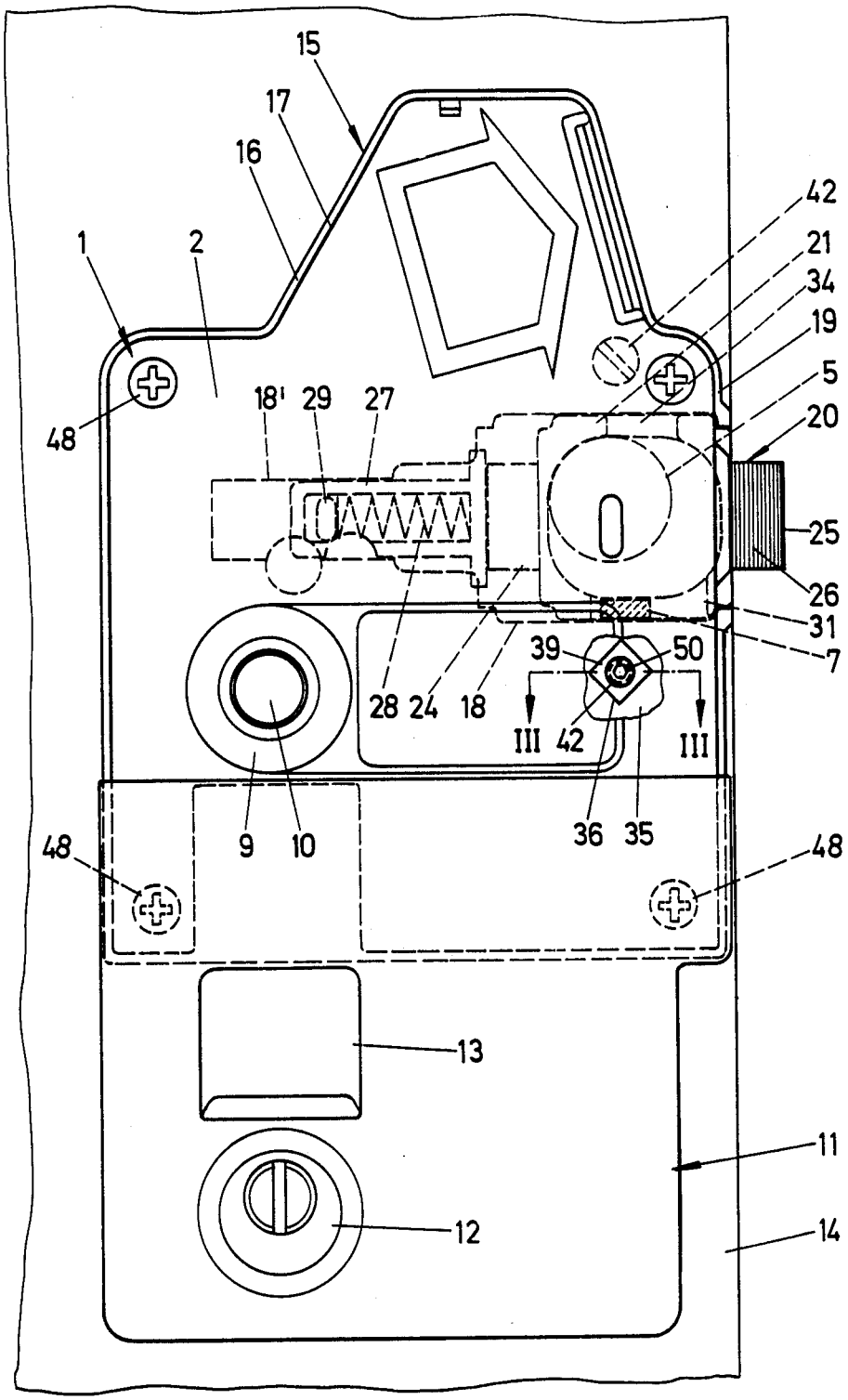
FIG. 1 is an elevational view of a lock mounted on the inside of a door and featuring a locking function which is releasably by coin drop, with the key operating element being in locking position.
Figure 2:
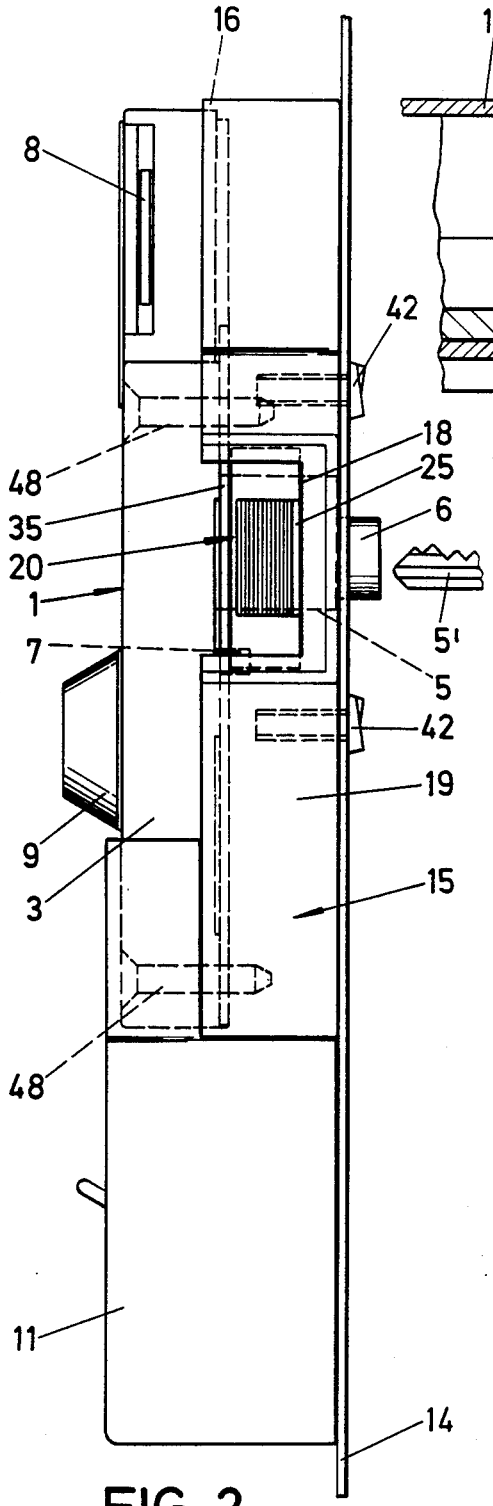
FIG. 2. is an end view of the lock seen from the fold side.
Figure 3:
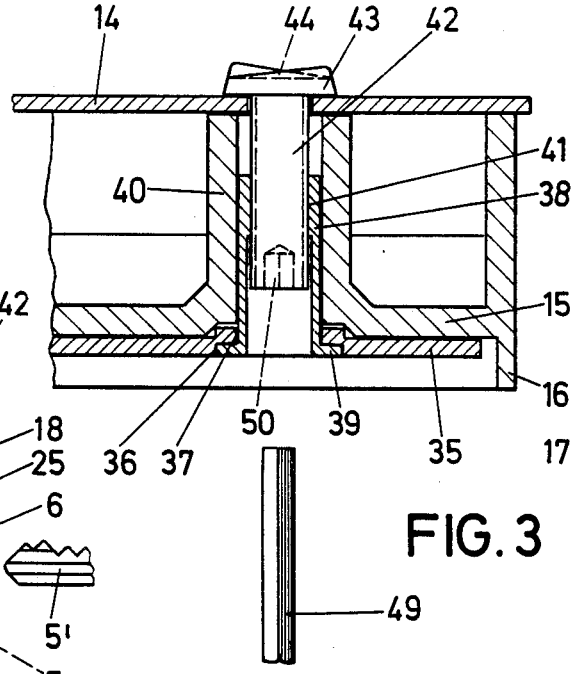
FIG. 3 is an enlarged sectional view taken along line III—III of FIG. 1 with coordinated removal tool.

The lock comprises a lock box 1. A surrounding lock box sidewall 3 originates from the lock box front wall. Not illustrated in detail, the interior components are covered by a plate 4 on which a cylinder 5 is mounted. The latter features on its free end face a stepped and eccentrically located extension 6. The cylinder plug can be turned by means of a key 5' which can be slipped into the cylinder and is illustrated only in part, thereby shifting by way of not illustrated components a key operating element 7 parallel to the bottom side of the lock box. But the operation of the lock requires first the insertion of a coin. The lock box 1 features for that purpose in its upper area a coin drop for a coin return key 10 originates from the lock box front.

The lock box 1 in the embodiment shown includes on its bottom side a coin compartment 11. It is attached to the lock box 1 with the aid of a cylinder 12 provided on the coin compartment 11. The coin compartment 11 includes a coin return opening 13 from which upon operation of the return key 10 the ejected coin can be removed.

The lock box 1 is mounted on the inside of the door 14 through the intermediary of a back plate 15. Its silhouette shape corresponds to that of the lock box. However, the back plate is dimensioned somewhat larger and provided with a recess 17 with a peripheral flange 16. In this way, the lock box 1 can partly engage the back plate 15, with its side wall, in form-fitting fashion.

On its broadside facing the lock box 1, the back plate 15 is provided with a channel 18. It originates from the end wall 19 of the back plate 15 and extends into a narrower channel section 18'. The channel 18 serves to receive the latching element 20. It consists of a frame 21 forming the latching element tail and the two heads 24 and 25 attached to the broadsides 22, 23 of said frame. These heads are preferably made from the same material as the frame 21 which runs in the channel 18, limited by a stop. The head 25 used according to FIGS. 1 through 8 features a bevel 26, whereas the other head 24 arranged toward the back plate is fashioned as a bolt head. Bearing on it is a slide 27 in the channel section 18' which, in turn, receives a compression spring 28. The latter bears on a projection 29 of the back plate, springloading in this way the bolt 20 in forward locking direction.

Engaging with its extension 6 a bore 14' in the door 14, the cylinder 5 extends through the frame opening 30 in such a way that the head 25 can be shifted backward by key operation. The key operating element 7 serves to retract the head 25 featuring the bevel 26. The key operating element enters an engagement opening 31 of the one frame shank 32 extending in the direction of shift. The engagement opening 31 has a length such that in the locked position of the key operating element 7 according to the position indicated by solid lines in FIG. 7 a free movement of the bolt 20 is possible. When moving the key operating element 7 in the unlocking position indicated by dash-dotted lines in FIG. 7, the bolt 20 is likewise entrained and the bolt head 25 disengages the locking recess in the door frame.

If the locking element 7 is in locking position and the door 14 is not closed, the bold 20 can yield against spring load, due to its bevel, when the door is pulled shut, and will then engage the locking recess in the door frame.

Figure 9:
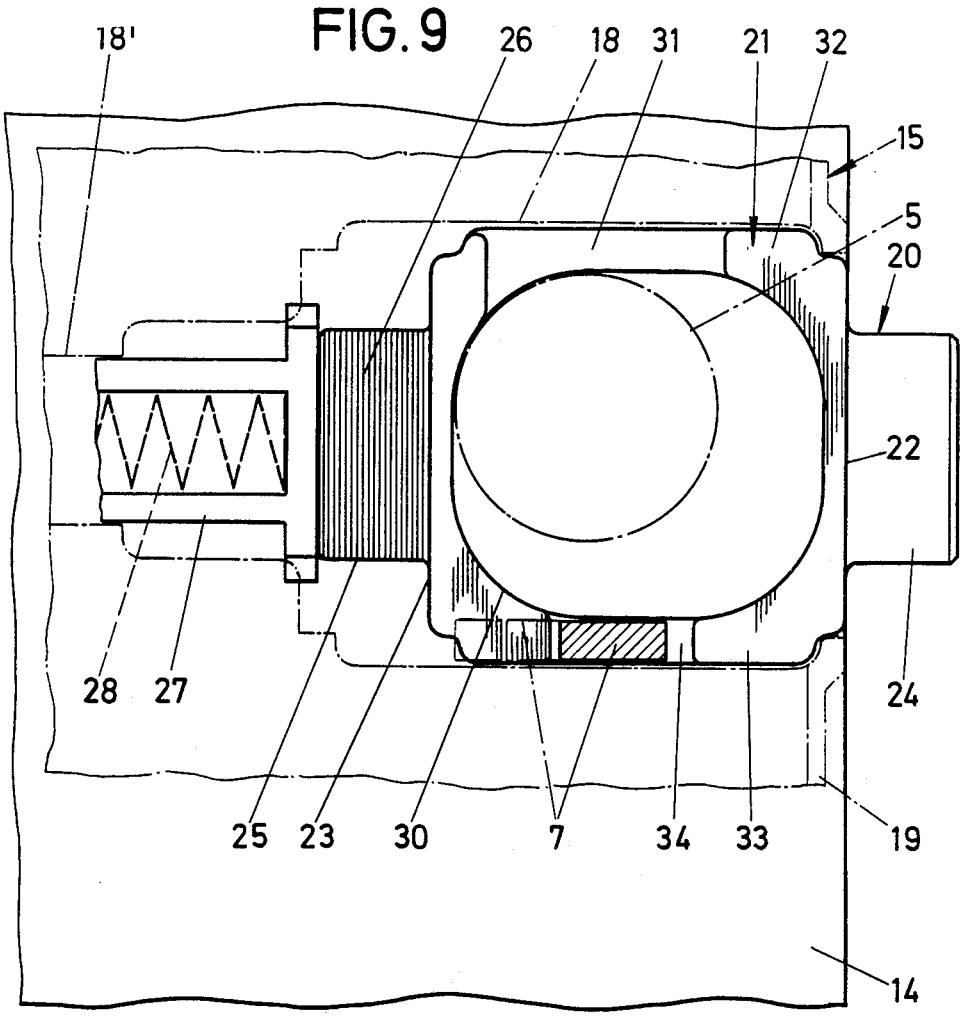
FIG. 9 is a view corresponding to FIG. 7, where the other head fashioned as a latching head is used for locking.
Figure 10:
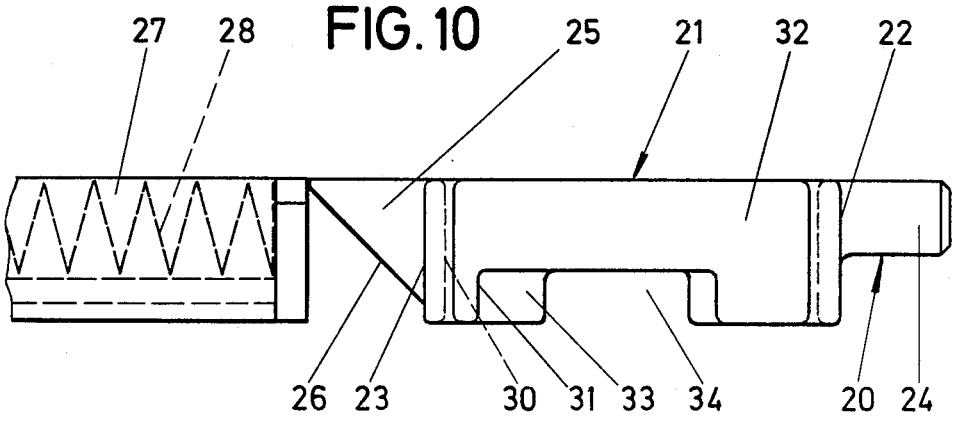
FIG. 10 is a corresponding plan view of the latching element with slide.

The frame shank 33 opposite the frame shank 32 also forms an engagement opening 34. But its length is only somewhat larger than the length of the key operating element 7. If a latching action of the element 20 is not required, the element 20 can be turned 180°, in the position according to FIGS. 9 and 10. The key operating element 7 engages then the opening 34 in the frame shank 33. Additionally, the head 24 is used, whereas the bolt head 25 is acted upon by the slide 27. The head 24 is retracted by key operation via the key operating element 7.

The bolt 20 contained in the channel 28 is retained by a cover plate 35. It features two square recesses 36 obtained by forming. Arranged in the recesses 36 are plain bores 37 for receiving bushings 38. The square head plates 39 of the bushings engage the recesses 36 in form-fitting fashion, thereby preventing rotation. Each of the bushings protrudes into a collar 40 of the back plate 15 which is swaged from the same material. The bushing 38 is provided with an internal threading 41 serving as an entrance opening for the screw 42 which is screwed in from the outside of the door.

Figure 4:
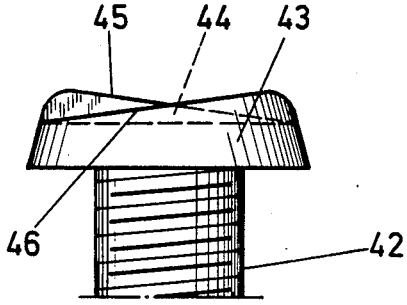
FIG. 4 is a partial elevational view of the screw holding the back plate.
Figure 5:
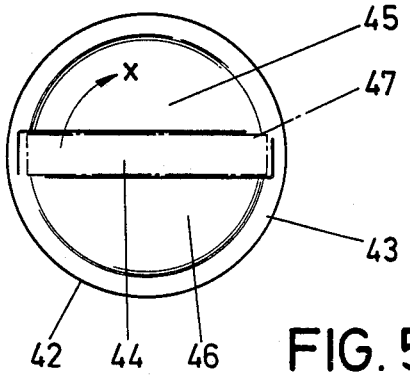
FIG. 5 is a plan view of this screw.
Figure 6:
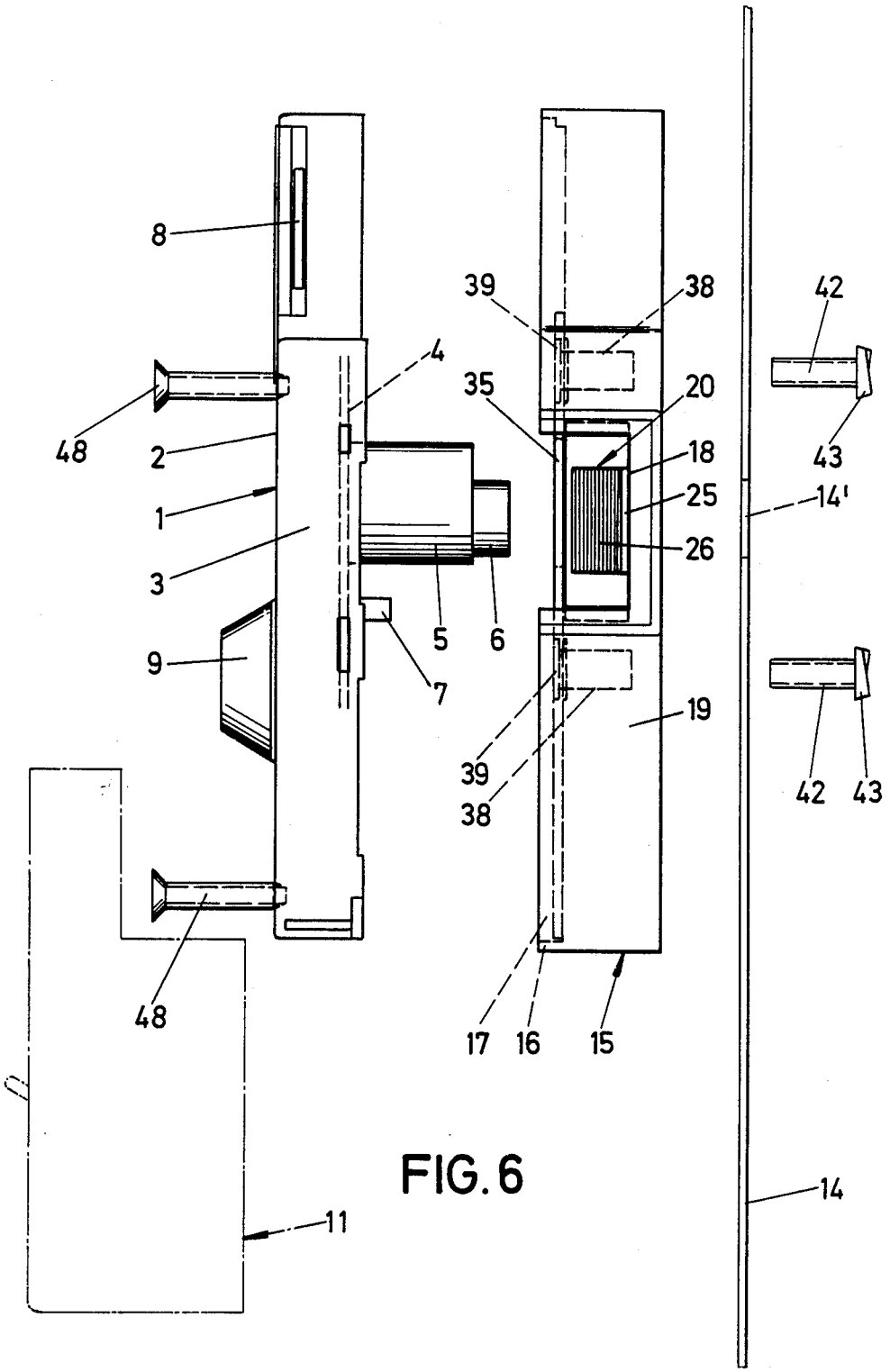
FIG. 6 is a side view of the door with back plate and lock box prior to installation, given an exploded view of the components.
Figure 7:
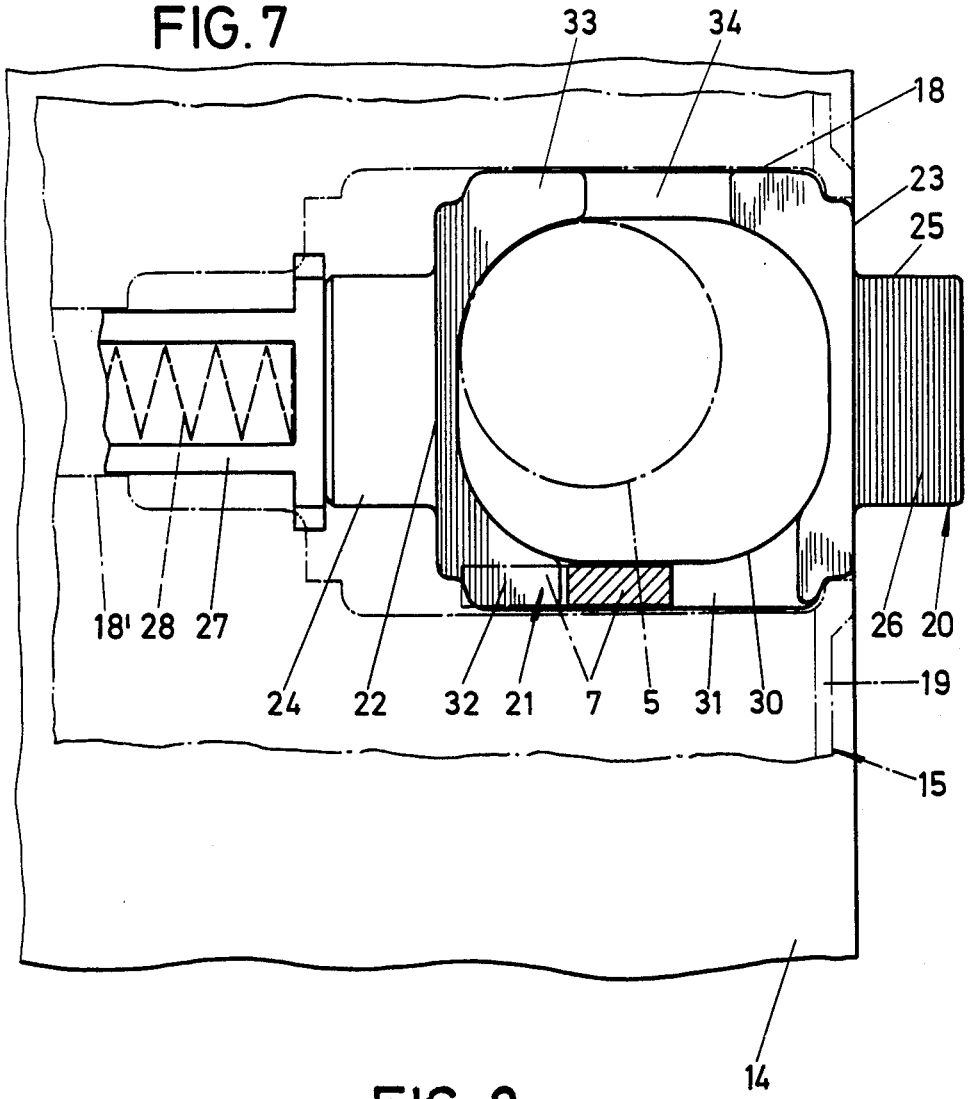
FIG. 7 is an enlarged sectional view of the back plate in the area of the latching element, with the beveled head in operating position.
Figure 8:
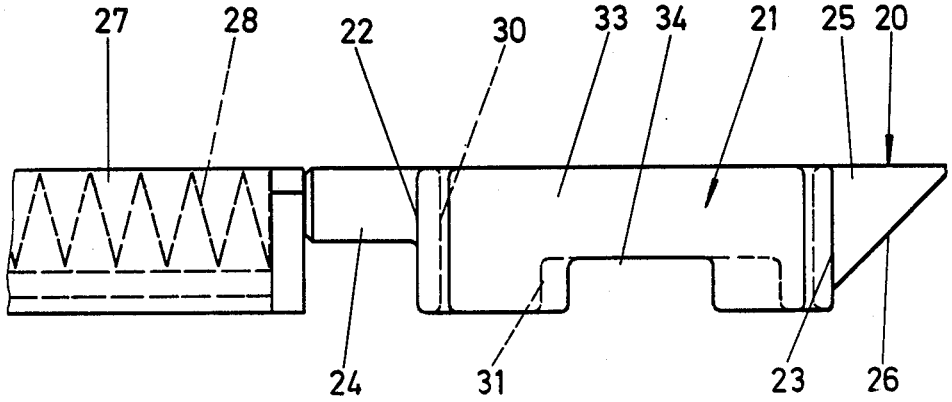
FIG. 8 is a plan view of the latching element with the slide applying the spring load on it.

Each screw 42 comprises a head 43 which tapers from its bearing face. The head is provided with a slot 44 and, adjoining it, with surfaces 45 and 46 shaped in a way such that by means of a screwdriver blade 47, indicated by broken lines in FIG. 5, the screw can be entrained only in clockwise direction x. The screw 42 itself has then a right-hand threading such as illustrated in FIG. 4. If an attempt is made at turning the screw 42 opposite to the direction indicated by arrow x, with the aid of the screwdriver blade 47, the blade will sip off the head 43 without producing any entrainment, due to the wedge-shaped surfaces 45.

The back plate 15 is fastened on the inside of the door 14 with the screws 42 described above. The lock box 1 is then installed in such a way that the cylinder 5 passes through the frame opening 30. Once a form-fitting connection has been established between the back plate 15 and the lock box 1, the box mounting screws 48 can be engaged. These are screwed in from the top side of the lock box, engaging the material of the back plate 15 and locking the lock box 1 in place. Thereafter, the coin compartment 11 can facultatively be hooked in and secured with the aid of the cylinder 12. Removing the lock from the door requires first the removal of the coin compartment 11. Next, the box mounting screws 48 can be removed and the lock box 1 taken off. The screws 42 are now accessible from the door inside. Their removal requires the use of a tool 49 having a hexagonal cross section. The screw 42 including a hex socket on its end facing toward the lock box contact surfaces. The tool 49 fits into the socket with a form fit, making it possible to unscrew the screw 49 from the bushing 38, whereafter the back plate 15 can be removed.

Next, the cover plate 35 is removable as well, permitting for instance a turning of the spring bolt 20.

From the foregoing disclosure of the general principles of the present invention and a detailed description of a preferred embodiment, those skilled in the art will comprehend various modifications to which the invention is susceptible. Therefore, we desire to be limited only by the scope of the following claims.

Having described our invention, we claim:

1. A lock having a locking function released by a coin drop, said lock comprising:

a lock box housing;

a key-operated locking device;

an operating element shiftable in response to operation of said locking device by said key;

a support casing adapted to be mounted on a door intermediate said door and said lock box housing for receiving and supporting said lock box housing;

a reversible latching element slidably mounted on said support casing, said reversible latching element having two heads formed on opposite end thereof, said support casing including a channel opening toward said lock box housing for receiving said latching element and guiding said element along a path of movement, said latching element being reversible about an axis extending transversely to the said path of movement of said latching element, said key-operated locking device being mounted within said channel of said support casing;

a spring-loaded slide carried by said support casing, said slide being separable from and engaging one head of said latching element and being effective to bias said latching element and another head of said latching element toward movement in a forward locking direction;

said operating element being engageable with said latching element to urge said latching element in a direction opposite to said forward locking direction.

2. The lock of claim 1 in which said latching element includes a frame forming the latching element, said frame including two shanks extending in the direction of movement of said latch member, said two heads being mounted on the ends of said frame, each of said shanks including an opening adapted to receive said operating element.

3. The lock of claim 2 in which one of said heads of the latching element forms a latch bolt, and one of said openings receiving said operating element is longer than the width of said element.

4. The lock of claim 2 in which said frame has a central opening and said key-operated locking device comprises a lock cylinder, said lock cylinder extending through said frame opening.

5. The lock of claim 1 in which the slide is mounted within said channel, and further comprising a spring disposed within said slide, said support casing comprising an abutment in engagement with said spring.

6. The lock of claim 1 comprising screw means connecting said support casing to said lock box, screws extending through said door for engagement said said support casing, said support casing having internally threaded entrance openings for receiving said screws, said screws having heads which permit only the transmission of inward turning forces, said screws having on their ends opposite to said head, gripping faces for engagement with a removal tool.

7. The lock of claim 6 further comprising insert-type bushings carried by said support casing, said bushings having head plates which are not round, said entrance openings being formed in said bushings.

* * * * *

UNITED STATES PATENT AND TRADEMARK OFFICE

CERTIFICATE OF CORRECTION

PATENT NO. : 4,817,404

DATED : April 4, 1989

INVENTOR(S) : Armin Eisermann, et al.

It is certified that error appears in the above-identified patent and that said Letters Patent is hereby corrected as shown below:

Col. 1, all of line 41 should be deleted.

Col. 2, line 6, "in" should be --to a--.

Col. 2, line 36, after "box" insert --top--.

Col. 3, line 23, after "drop" insert --8 which is accessible from the narrow side of the lock box. Also, a collar 9--.

Col. 4, line 4, "bold" should be --bolt--.

Col. 4, line 19, "28" should be --18--.

Col. 4, line 39, "sip" should be --slip--.

Col. 6, line 29, "head" should be --heads--.

Signed and Sealed this

Thirtieth Day of January, 1990

*Attest:*

JEFFREY M. SAMUELS

*Attesting Officer* *Acting Commissioner of Patents and Trademarks*